United States Patent [19]

Gordon et al.

[11] 4,283,657

[45] Aug. 11, 1981

[54] EXIT ILLUMINATING SYSTEM

[75] Inventors: Joseph H. Gordon, Nanuet; R. Ramon Bloch, Yonkers, both of N.Y.

[73] Assignee: Lampiridae Associates, Conn.

[21] Appl. No.: 878,467

[22] Filed: Feb. 16, 1978

Related U.S. Application Data

[63] Continuation of Ser. No. 670,118, Mar. 25, 1976, abandoned.

[51] Int. Cl.[3] ..... G08B 17/10

[52] U.S. Cl. ..... 315/86; 307/86; 340/331; 340/332; 340/371; 340/628; 340/691

[58] Field of Search ..... 315/86, 87, 129, 241 R, 315/200 A; 307/23, 39, 66, 86; 328/3; 340/324 R, 326, 331, 371, 628, 28, 77, 88, 105, 528, 629, 630, 691, 693, 332; 362/20, 254

[56] References Cited

U.S. PATENT DOCUMENTS

| | | | |
|---|---|---|---|
| 2,106,968 | 2/1938 | Dannheiser | 315/86 X |
| 2,905,863 | 9/1959 | Martin et al. | 315/241 S |
| 3,237,052 | 2/1966 | Sokolov | 315/200 A X |
| 3,573,541 | 4/1971 | Dunn et al. | 307/23 X |
| 3,609,506 | 9/1971 | Frezzolini et al. | 307/66 X |
| 3,774,186 | 11/1973 | Enemark | 340/237 S |
| 3,792,309 | 2/1974 | McDonald | 315/200 A |
| 3,810,170 | 5/1974 | Zinsmeister | 340/331 X |
| 3,846,773 | 11/1974 | Lintelmann et al. | 340/630 X |
| 3,916,404 | 10/1975 | Gouge | 340/371 |
| 4,029,994 | 6/1977 | Iwans | 315/323 |
| 4,074,225 | 2/1978 | Vandeweghe | 340/691 X |

FOREIGN PATENT DOCUMENTS

| | | | |
|---|---|---|---|
| 696905 | 10/1964 | Canada | 315/86 |

*Primary Examiner*—Eugene R. LaRoche

*Attorney, Agent, or Firm*—Morgan, Finnegan, Pine, Foley & Lee

[57] ABSTRACT

An exit illuminating system for illuminating an exit or exit sign with high intensity light under emergency conditions, the light having sufficient brilliance to be visible through smoke in order to lead persons who may be trapped in the smoke-filled area to the escape exit. The system incorporates an emergency condition detector responsive to power failure, smoke and heat in order to develop an activating signal which energizes a high intensity xenon flash lamp. The system is made fail-safe by a circuit which causes a battery to power the flash lamp if line power is lost and which keeps the battery at full charge when external power is available.

4 Claims, 4 Drawing Figures

EXIT ILLUMINATING SYSTEM

This is a continuation of application Ser. No. 670,118 filed Mar. 25, 1976, abandoned.

BACKGROUND OF THE INVENTION

This invention relates to an emergency lighting system and, specifically, to a system for illuminating an exit, exit sign or other indication of a suitable escape route from a protected area under emergency conditions.

Almost everyone recognizes the familiar "EXIT" sign over the doors of buildings which lead to stairwells, corridors or the street. It is the essential and primary purpose of these exit signs to indicate to persons in the building exactly where the exit doors are so that under emergency conditions the exits can be located for quick evacuation of the premises. Indeed, almost every local safety code requires the provision of illuminated exit signs at all strategic locations.

Some local regulations require, in addition, that the emergency or exit lighting be provided with continuously available auxiliary power in the event of line power failure. This is to insure that the exit signs remain lighted even when a power failure occurs as a result of fire or electrical fault.

One such exit lighting system is found in U.S. Pat. No. 3,486,068. This system comprises a self-contained unit within the exit lighting fixture and includes a rechargeable battery and dual filament lamps normally supplied with alternating current line power through a transformer. Upon any loss of alternating current power, relays are operated to send battery current to the lamps to keep them illuminated. Conceivably, during an emergency condition causing loss of line power, persons would be able to find their way out, provided that the exit sign remains visible to them.

Another known system combines a standby auxiliary (battery) power feature with strategically placed heat detectors so as to provide normal exit lighting and a visual and audible alarm in the event that the temperature exceeds a predetermined limit indicating a fire or dangerous temperature condition. This system causes the incandescent lamps used to illuminate the exit sign to flash in order to better draw attention to the exit. The audible alarm is used to provide a warning in addition to helping persons locate the exit.

There are, in addition, a number of emergency lighting systems for general use which implement rechargeable batteries in order to maintain power to a lighting load in the event of power failure. In some of these systems, e.g., those disclosed in U.S. Pat. Nos. 3,819,980 and 3,771,012, electrical circuits are implemented which permit a lighting load to be continuously energized so long as the battery charge is sufficient. In one case, an electronic inverter is used to convert the DC battery power to AC power for the load. When the battery voltage falls below a predetermined level the inverter ceases to operate until such time as the battery recovers its charge. This results in a cyclical operation of the emergency lighting system and a blinking of the lights as the battery recovers and discarges. In another case, the battery power is supplied intermittently to the load in order to prolong bettery life and "attract attention to the power failure".

Unfortunately, none of the foregoing measures gives effective and reliable emergency lighting under what is perhaps one of the most common, and most deadly, of emergency conditions the smoke-filled room. Smokey fires are now commonplace, particularly with the proliferation of plastics and other similar materials which produce dense and acrid smoke when burning. The ordinary exit light often becomes inoperative due to loss of electrical power. Even if the emergency lighting or auxiliary power source is operating properly, the exits cannot be located because the illuminated exit indicators cannot be seen through the smoke. Although some smoke detector systems are available, e.g., that disclosed in U.S. Pat. No. 3,659,278, the system simply provides an alarm and does not help people to escape safely. In still other cases, the exit lights do not respond at all to either heat or smoke due to fires.

The shortcomings of systems now in use are dramatically underscored by all-too-common tragedies. In June of 1974, 24 young persons died from smoke inhalation caused by fire in a structure adjacent to a popular restaurant-discotheque. The kitchen of the establishment was equipped with a fire alarm system but the initial heat from the fire did not reach that area and did not set off the alarm. Smoke was present, but there were no smoke detectors in the building. Furthermore, the building was equipped with an emergency lighting system which had been tested by local authorities a few months earlier and were found to be operative. The building had six exits, all in working order and all marked with signs. Nevertheless, the thick smoke which permeated the room prevented the exit signs from being seen. This fact was a primary contributor to the shocking toll of lives in that incident in which all those who died could have escaped had they been able to find their way out.

In late 1975, seven persons died of smoke inhalation in a New York City nightclub after a fire, apparently electrical in origin, caused a power failure. Patrons and employees became hysterical because they could not find their way to an exit as dense smoke filled the room. Some persons who did escape were able to do so only by groping their way along walls until the street door was found. Those who died apparently mistook the washroom door as an escape route and there suffocated.

In each of these tragic incidences, the exits were maintained in accordance with fire code regulations and the casualties were the result of smoke inhalation and the inability to find the exit in darkness and smoke. In one of the cases, an emergency lighting system, assumed to have been operative, failed to direct the victims to a safe route of escape.

It is a principal object of the present invention to provide an emergency exit lighting system for directing those who may be trapped in a protected area to a safe route of escape under emergency conditions, including that of smoke, fire and power failures.

Another object of the invention is to provide a fail-safe exit lighting system which is inexpensive and reliable and suitable for installation in any public place, no matter what its size.

It is a general and overall object of the present invention to provide a system capable of preventing the tragic and needless loss of human lives due to inadequate emergency condition exit systems.

SUMMARY OF THE INVENTION

These and other objects of the invention are attained in an exit illuminating system which includes means for sensing the presence of an excessive amount of smoke in a protected area, together with a source of high intensity illumination which is responsive to the smoke sensing means for illuminating the exit with a high intensity, preferrably flashing, light of sufficient brilliance to be seen through the smoke-filled atmosphere so as to guide persons who may be trapped to an escape route via such exit.

In preferred embodiments of the invention, the system is composed in a self-contained unit suitable for mounting adjacent the exit and includes a rechargeable battery which automatically supplies power to the high intensity source of illumination in the event of line power failure. The apparatus preferably also incorporates fire or heat sensors used in conjunction with the smoke sensing means to as to trigger the high intensity light source under these emergency conditions also.

A fail-safe feature is incorporated into the preferred embodiment to insure an auxiliary source of power to the system in the event of power line failure, the auxiliary power source including a battery and means to provide a regulated source of charging current to the battery during normal operation. In addition, the system may incorporate an audible alarm which may take several forms, including a directional audio signal or a recorded message instructing persons how to reach the exit.

The high intensity source of illumination, for example an electronic flash unit of suitable luminosity, supplements the normal exit lighting, usually of the incandescent type, which may continue as operative so long as line current remains available.

DESCRIPTION OF PREFERRED EMBODIMENTS

Although the system in accordance with the invention can be used as a conventional fire or other emergency condition detector, two elements of the system are essential to be effective in achieving the primary objects of providing a safe exit illuminating system in the event of fire and smoke. These elements are a smoke detector and a source of high intensity illumination which responds to the detector to light up the exit indicator with sufficient brilliance to be seen through smoke. As we have seen, neither element standing alone in a conventional system would provide the sought after human safety. Nevertheless, the system is adapted for integration into conventional or existing fire detection systems and with other types of emergency condition sensors, such as heat sensors and gas sensors. Built into the system is the inherent capability for warning against power failures, smoke and fire, and the system is fail-safe such that it will operate in the event of AC line power failure.

Figure 1:
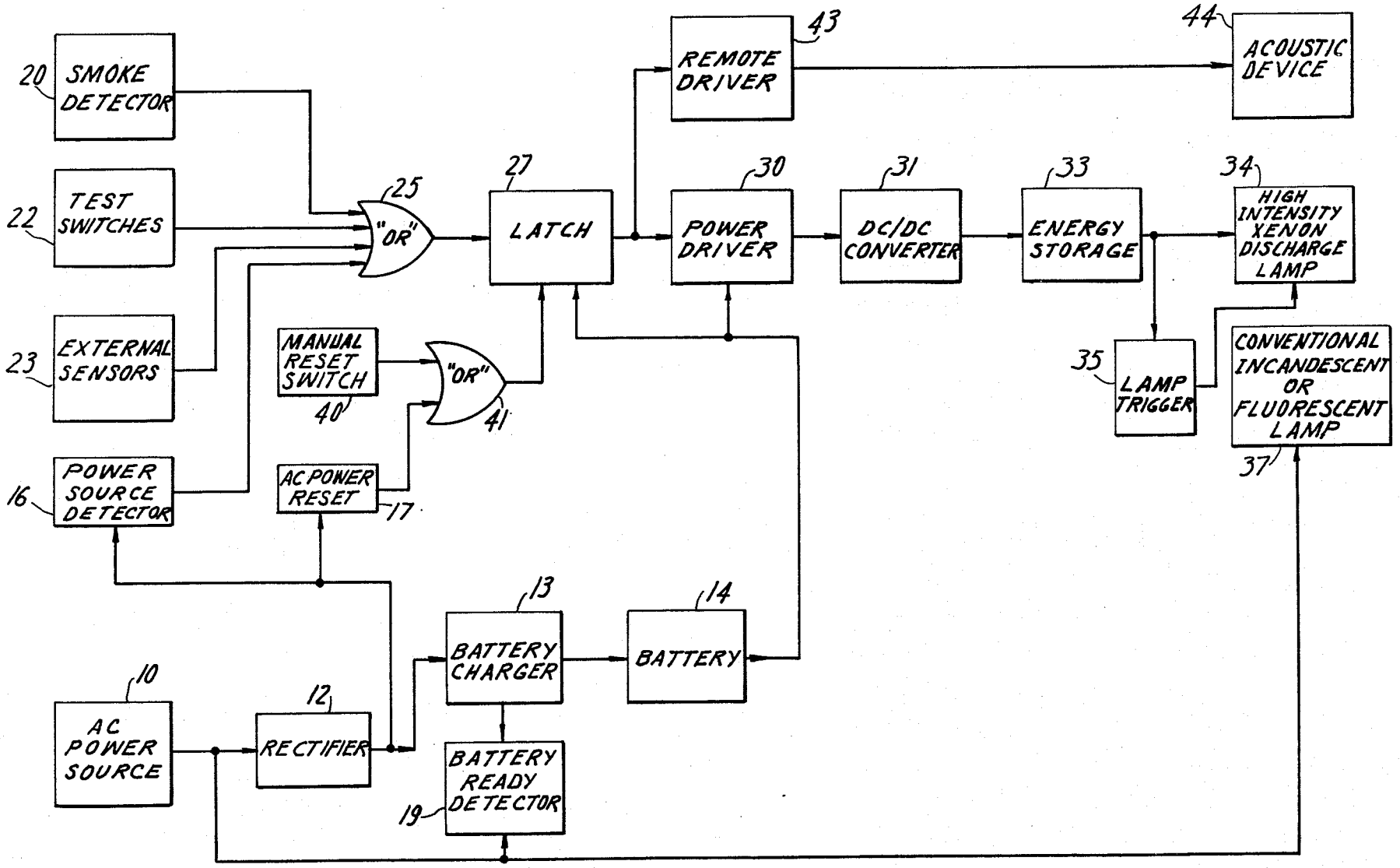
FIG. 1 is a schematic block diagram of an exit illuminating system in accordance with the invention.

Referring now to FIG. 1, the system is connected to an ac power source 10 which is converted into direct current power by the rectifier 12. This direct current supplies a battery charger circuit 13 that provides a continuous source of charging current for the batter 14 which constitutes the auxiliary source of power in the event of failure of the ac power source 10. Rectifier direct current is also supplied to a power source detector 16 for sensing line power failure, and to an automatic reset circuit 17 whose function will be explained shortly. Connected to the battery charger 13 is a "battery ready" detector which lights an indicator when the battery is at full charge. It will be understood that the battery 14 powers the operative elements of the system while the battery charge is continuously being replenished by the battery charger circuit 13.

The system is activated by appropriate signals from a smoke detector 20 and any of a number of supplementary external devices including test switches 22, auxiliary external emergency condition sensors 23 which may include heat detectors, gas sensors, etc. All these input signals are gated through OR circuit 25 to a latch 27 whose input signal constitutes an activating signal for the system. Thus, when any signal input to the OR circuit 25 is present, an activating signal will be present at the output of the OR circuit and will energize the latch 27.

The function of the latch 27 is to maintain operation of the high intensity light source once the smoke detector or one of the other inputs has been activated. For example, if the heat sensor detects the presence of fire and sends a signal through the OR circuit 25 to the latch 27, the latch 27 will cause a high intensity lamp source to become energized and to remain so, even should the heat sensor become destroyed or inoperative thereafter. This means that the system would continue to function if the sensors themselves, once causing activation of the alarm, are consumed by fire.

Energizing the latch 27 enables power driver circuit 30 to supply battery current to a DC/DC converter 31, which converts low voltage direct current from the battery into high voltage direct current. This high voltage direct current is provided to an energy storage device 33 which discharges periodically into a xenon discharge lamp 34 under control of a lamp trigger circuit 35. The latter senses when the energy stored in the element 33 has attained a level sufficient to illuminate the xenon discharge lamp 34. When stored energy has attained that level, the energy is released to the xenon lamp.

The entire system may be housed within a single housing constituting the actual exit lighting fixture and, in that connection, the fixture may include a conventional incandescent or fluorescent lamp 37 connectable directly to ac line power.

As will be explained shortly in more detail, the system is designed to energize the xenon discharge lamp in the event of line power failure. This function is accomplished by the power source detector 16, which constitutes one of the inputs to the OR circuit 25. Under any emergency circumstances, such as excessive smoke or heat or power failure, the high intensity xenon discharge lamp will continue to flash until such time as the latch 27 is reset. To this end, the power reset circuit 17 output is gated with a manual reset signal through the OR gate 41 to automatically reset the latch and turn off the high intensity lamp once line power has been restored. However, the latch 27 will be ready to reset only if no other emergency condition inputs are present. Thus, should the smoke detector 20 continue to sense the presence of an excess amount of smoke, the high intensity discharge lamp will continue to be illuminated even if line power is available.

In addition to activating the high intensity light source 34, the system may be used to energize audio devices. When such devices are used, the signal from the latch 27 couples battery power to a remote driver circuit 43 and an associated acoustic device 44. These elements my also be self-contained in the exit lighting fixture or may be disposed separately. Examples of acoustic devices are an alarm or, preferably, a simple magnetic tape player for audibly reproducing a message recorded, for example, on a continuous tape cartridge. Such a message might direct a person to one or more exits and desirably would instruct persons to proceed toward the nearest high intensity flashing light.

In review, the exit illuminating system of FIG. 1 is seen to incorporate several features of safety and reliability. First, it incorporates a smoke detector and a high intensity light source visible by persons through smoke which may permeate the atmosphere in the protected area. It is thus designed to lead persons safely to an exit from the protected area even in cases where the heat is not sufficiently intense to activate any fire detector. The system is, however, fully compatible with the heat sensors or other fire detectors and is energizable and will become activated upon the occurrence of any of a number of emergency conditions, including failure to alternating current line power. A continuously charged battery supplies electrical current to the system upon failure of line power. Moreover, the high intensity light source continues to illuminate the exit sign even after any of the emergency condition sensors become inoperative or destroyed. The system is thus fail-safe. The system is compact and is easily packaged within the lighting fixture, the exit lighting fixture itself requiring only the customary and available connection to house current.

DETAILED DESCRIPTION OF CIRCUIT OPERATION

Figure 2A:
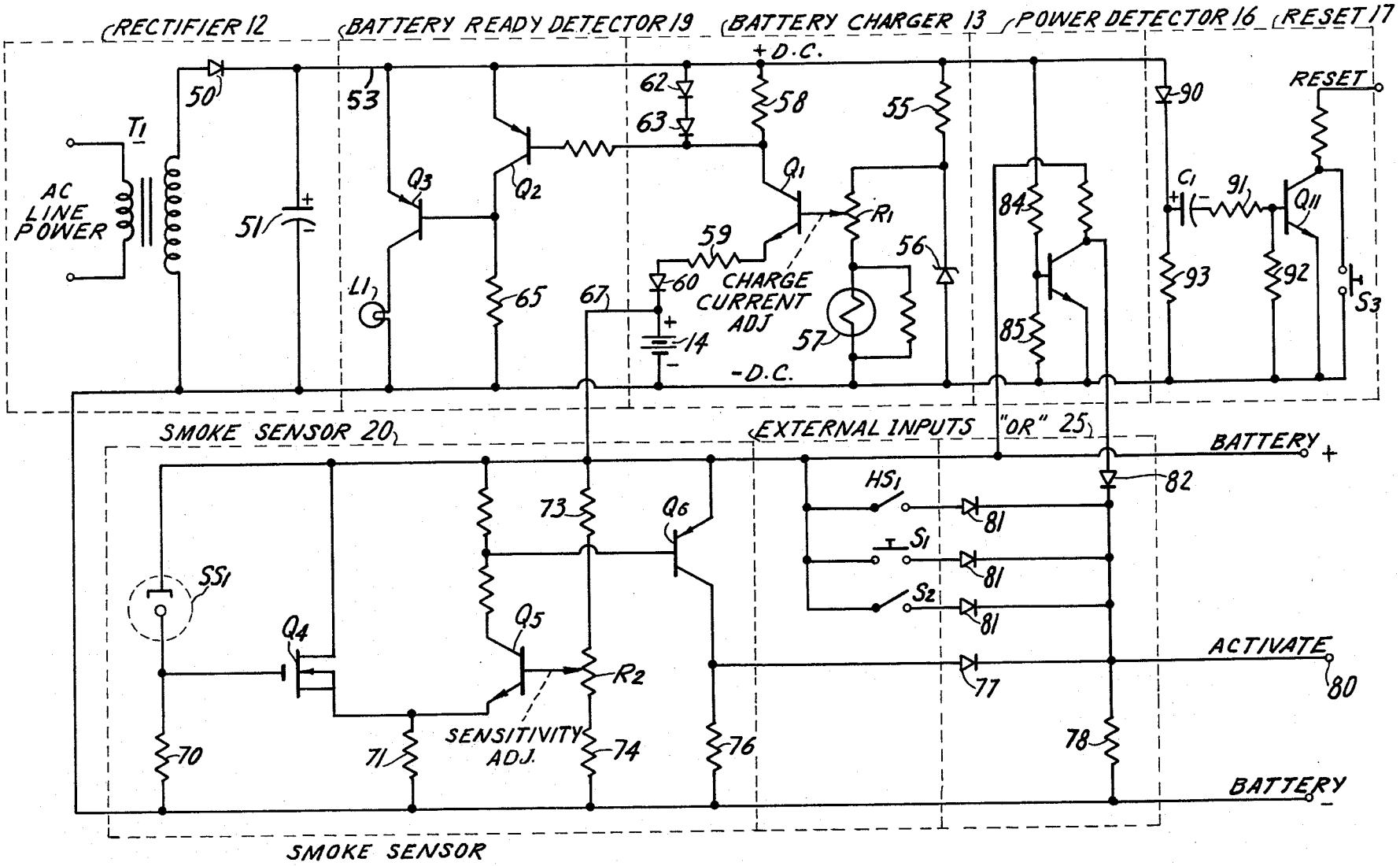
FIGS. 2A and 2B are electrical schematic diagrams of the components of the system shown in block form in FIG. 1.

Turning now to the circuit schematic diagram of FIG. 2A, wherein the dashed lines generally surround the components making up the units of the system described in FIG. 1, line power is supplied to the apparatus through the input transformer T1. The transformer, together with the diode 50 and capacitor 51, constitute the rectifier for converting the ac current into dc current for powering the electronic components. Rectified direct current appears on the conductor 53 and supplies the battery charger 13.

In the battery charger, rectified direct current is supplied through a resistor 55 to a zener diode 56 which establishes a reference voltage across a series circuit including a potentiometer R1 and a thermistor 57. The resistor R1 is adjusted so as to furnish the desired quiescent charging current to the battery 14 through the transistor Q1 under normal operating conditions.

The battery charging circuit operates as follows: Transistor Q1 normally conducts by an amount determined by the bias voltage from the adjustable potentiometer R1. Transistor current flows through the resistor 58, the collector-emitter circuit of the transistor Q1, and through the resistor 59 and diode 60 to the positive terminal of batter 14. If the battery voltage drops, calling for more charging current, the emitter-base voltage of the transistor Q1 automatically increases, and transistor Q1 supplies more current. The thermistor 57 in the biasing circuit for transistor Q1, compensates the quiescent charging current for temperature variations which are normally reflected in the full-charge battery voltage. It should be noted at this point that the positive terminal of the battery is connected to the other electronic elements of the apparatus and, accordingly, the current to the transistor Q1 will normally include a component constituting the normal current drain of the system.

When the battery is at full charge, the battery ready detector 19 is operative to illuminate the indicator lamp L1, thus providing a visible indication at all times of the status of the battery. If the battery falls below its normal charge, the lamp L1 is turned off. This is accomplished in the following manner. When normal trickle charging current is being drawn by the transistor Q1, the voltage across the resistor 58 is less than the forward conducting voltage of the transistor Q2 which is therefore nonconducting. Under these circumstances, the transistor Q3 is forwardly biased and is fully conductive so as to illuminate the lamp L1. When the battery 14 draws more current through the transistor Q1, however, (battery not fully charged), the voltage across the resistor 58 increases (up to the forward conducting voltage drop across the diodes 62, 63) and biases the normally nonconducting transistor Q2 into the conductive region. This causes the voltage across the collector resistor 65 to rise and reduces the bias voltage for the transistor Q3 to a degree sufficient to turn off Q3 and extinguish the lamp L1.

Once the battery becomes charged, the voltage across the resistor 58 will again decrease to a degree sufficient to bias the transistor Q2 into nonconduction, permitting the transistor Q3 to turn on again and illuminate the indicator lamp L1. It should be noted that diodes 62, 63 provide a low voltage drop path for charging current during times when the battery 14 demands large current at full or nearly-full discharge.

In the event of power failure, the diode 60 and transistor Q1 become nonconductive and effectively isolate the battery 14 from the rectifier 12, battery-ready detector 19 and battery charger circuit 19. The battery 14 then becomes the sole source of current for the system.

The smoke sensor 20, shown in FIG. 2A, incorporates a smoke sensor SS1 of the ionization type. This sensor includes an ionization chamber having alpha particles emitted from a radioactive source which bombard the air particles inside the chamber to ionize them. Under normal conditions, a small current (e.g., 20 pico amperes) flows in the chamber and through the resistor 70 to establish a predetermined voltage across the resistor 70 and a predetermined amount of current through the high impedance field effect transistor Q4 and resistor 71. This field effect transistor Q4 together with the transistor Q5 constitute a differential amplifier. The current through the resistor 71 gives rise to a quiescent voltage at the emitter electrode of the normally nonconductive transistor Q5, whose base voltage is set by the voltage divider constituted of the resistors 73, 74 and the potentiometer R2. When the transistor Q5 is nonconductive, the transistor Q6 is also nonconductive.

If any smoke enters the ionization chamber of the smoke sensor SS1, the ionization current is reduced, causing the field effect transistor Q4 current to decrease. If an excess amount of smoke is present, this reduction in current is sufficient to bias the transistor Q5 into conduction. Transistor Q6, in turn, also conducts to develop an output signal across the resistor 76. This signal is fed through the diode 77 to the summing junction (terminal 80) of the OR circuit 25 which produces a logic "1" voltage level across the output resistor 78 when any of the inputs to the OR circuit are logic "1". The other inputs made available to the OR circuit are the push-to-test switch S1, the manual alarm switch S2 and one or more external heat sensors HS1 which may comprise, for example, bimetallic elements or other suitable thermo-sensitive devices. Each of these signals is fed through one of the OR circuit input diodes 81.

A further input to the OR circuit is via diode 82 which receives the output signal from the transistor Q10 in the power detector circuit. This circuit operates so as to provide a logic "1" input to the OR circuit in the event of line power failure. When ac line current is available, a dc bias voltage appears across the voltage divider constituted of resistors 84, 85, thus biasing the transistor Q10 into conduction and effectively tying the anode of the diode 82 to the negative battery terminal. When power fails, however, the bias voltage applied to the transistor base disappears, and the transistor Q10 ceases to conduct. In this case, the full positive battery voltage appears at the anode of the diode 82 and produces a logic "1" output of the OR circuit at the terminal 80. A logic "1" output signal at the terminal 80, irrespective of the particular emergency condition causing it, constitutes an activating signal for the high intensity flash lamp upon activation of the latch 27.

Figure 2B:
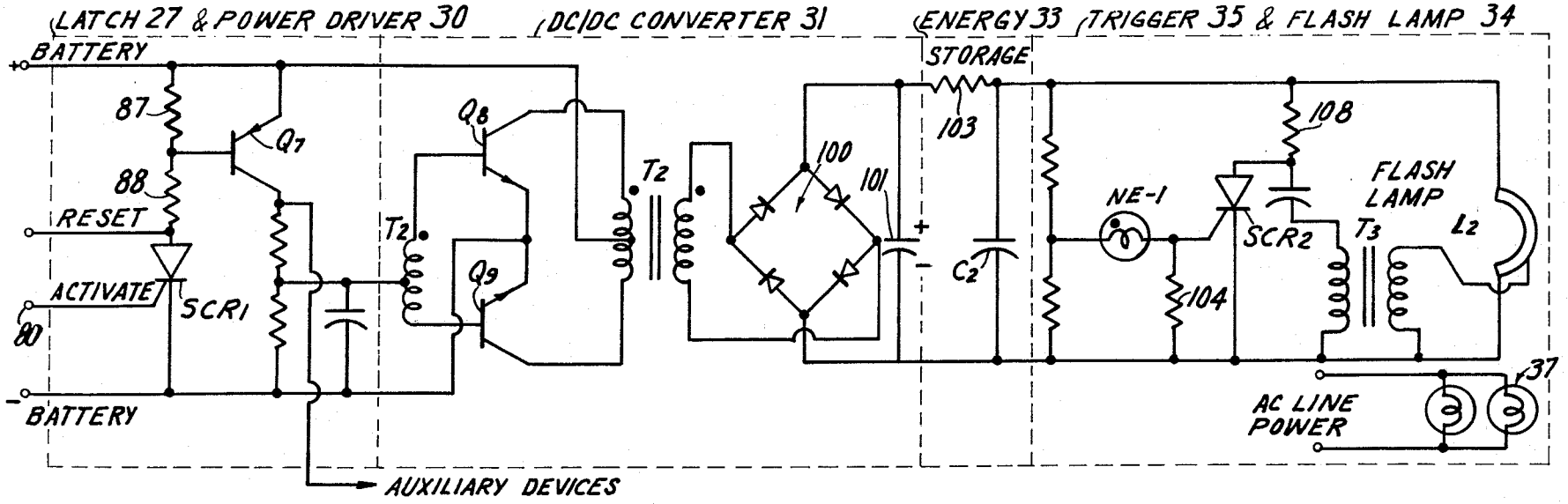

Referring now to FIG. 2B, the transistor Q7 of the power driver 30 is normally nonconductive. This transistor serves as an on/off switch for the high intensity flash lamp and any other auxiliary devices to be energized upon occurrence of emergency conditions. The transistor Q7 is brought into operation by the latch 27, which includes a silicon control rectifier SCR1 in series with the voltage divider network 87, 88. Normally, SCR1 is nonconductive, thus biasing the transistor Q7 off (no current flows through voltage divider 87, 88). When an activation signal occurs at the terminal point 80, however, the gate electrode of SCR1 is energized and, being thus triggered, the forwardly biased SCR1 conducts. When this occurs, current is drawn through the voltage divider network 87, 88 to bias the power driver Q7 into conduction. Once energized, of course, SCR1 remains conductive as long as battery voltage is available, whether or not the activation signal applied to the gate electrode of the rectifier is present. SCR1 is thus latched unless and until it is reset by the reset circuit 17 shown in FIG. 2A.

Referring again to FIG. 2A for the moment, the reset of the latch 27 occurs if two conditions are satisfied: (1) all inputs to the OR circuit 25 are logic "0" and (2) a reset signal is provided the reset circuit 17. Thus, a reset SCR1 rendered nonconductive can be brought about by depressing the manual reset switch S3, which shorts the anode and cathode of SCR1. Similarly, SCR1 may be reset upon conduction of the normally nonconductive transistor Q11. If rectified direct current (and therefore line current) is available, the capacitor C1 is charged through the diode 90 and resistors 91 and 92. When capacitor C1 achieves full charge, no current flows through the voltage divider resistors 91, 92 and no base current flows to the transistor Q11. It is therefore cut off. Once line power is lost, on the other hand, the capacitor C1 discharges through the resistors 93, 92 and 91 to reverse bias transistor Q11 and assure its cut-off. Upon restoration of line power, the capacitor C1 again charges up, during which time current flows through the resistors 91, 92, biasing transistor Q11 momentarily into conduction and resetting SCR1.

If during an attempted reset an emergency condition (e.g., smoke) is still present, there will be an activating logic "1" signal at terminal 80. This signal will trigger SCR1 into conduction after a short delay determined by the charging time of the capacitor C1. The latch 27 will thus be energized even if line power is restored. The system is thus fail-safe in this additional respect because even an inadvertent attempt to reset the system will be overridden in any real emergency.

Returning again to FIG. 2B, conduction of transistor Q7 in the power driver 30 provides the bias needed for Q8 and Q9 to oscillate using saturable transformer T2 of an electronic inverter. As understood by those in the art, the inverter is an oscillator whose output is stepped up through the secondary winding of the output section of the transformer T2. The stepped-up voltage is rectified in a conventional bridge rectifier 100 and filter capacitor 101, and a high voltage dc signal, typically 400 volts, appears at the positive terminal of the capacitor 101.

This high voltage charges the capacitor C2 through the resistor 103 until it reaches a level sufficient to cause the neon lamp NE1 to ionize and thus develop a trigger signal across resistor 104. That trigger signal is applied to the gate of the silicon control rectifier SCR2, which then conducts to discharge capacitor 105 of the flash lamp trigger circuit through the primary of transformer T3. The secondary of T3 is connected to the trigger electrode of the high intensity xenon flash lamp L2, and the energy stored on the capacitor C2 discharges through the lamp, providing high intensity illumination. When capacitor C2 becomes discharged, the neon lamp ceases to conduct, as does the silicon control rectifier SCR2. Thereafter, capacitor 105 is charged through the resistor 106, and capacitor C2 again begins to accumulate a charge at a rate determined by the value of the resistor 103. The flash lamp L2 is thereby repeatedly flashed until the apparatus is reset or until the battery charge is depleted.

An advantage to the use of the high intensity flash lamp is not only that it provides extremely brilliant illumination visible through dense smoke, but conserves battery power. Moreover, the frequency and duration of the flash can be chosen to meet any given requirement. Typically, the battery will have a rating of about 5 ampere hours, but obviously can be chosen to have greater or lesser life per charge, if so desired.

Figure 3:
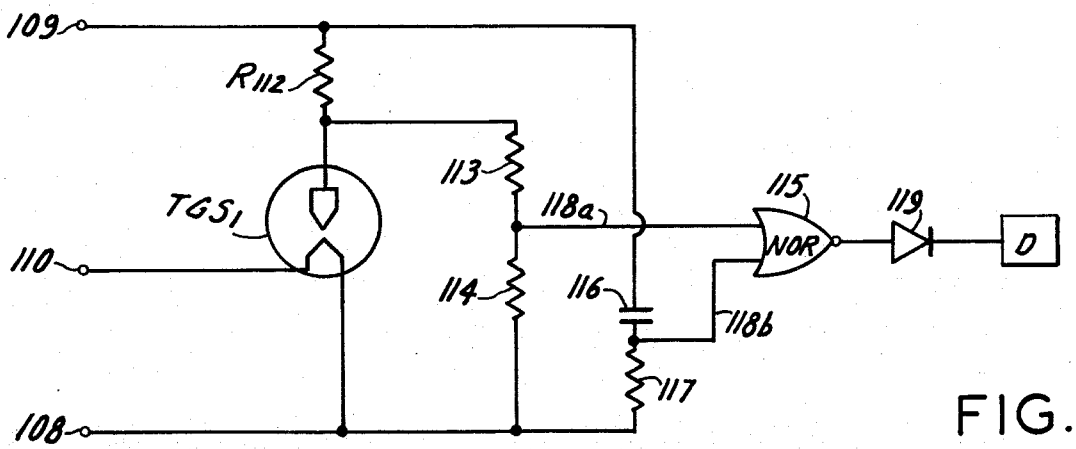
FIG. 3 is an electrical schematic diagram of an alternate form of smoke sensor suitable for use with the invention.

FIG. 3 represents an alternate kind of smoke detector which can be used in place of the ionization type smoke detector shown in FIG. 2A. In FIG. 3, TGS1 represents a smoke sensor of the Taguchi type. Rectified dc is applied between the terminals 108 and 109, and ac filament voltage between terminals 108 and 110. Under normal conditions, a current flows through the resistors 112, 113 and 114 and a small current flows through the sensor device TGS1. The positive voltage at the junction of resistors 113 and 114 causes a logic "1" at input **118*a* of the NOR gate 115. When an excess degree of smoke is present, however, TGS1 conducts heavily and reduces the voltage across the resistors 113 and 114 giving a logic "0" to input 118*a* of the NOR gate 115**.

A second input to gate 115 comes from the junction of the capacitor 116 and resistor 117, and a logic "1" is applied to the second input of the NOR gate only momentarily during initial application of power. Under normal conditions, therefore, the second input **118*b* to NOR gate 115 is "0". The output of NOR gate is a logic "1" only when both inputs are logic "0". This occurs upon heavy conduction of the Taguchi gas sensor TGS1 after the initial stabilization period and represents an excessive smoke condition. The output of NOR gate 115 feeds diode 119, which would be coupled to OR gate terminal 80 in place of diode 77** so as to produce an appropriate activating signal.

Although the Taguchi gas sensor circuit of FIG. 3 is less costly than the ionization smoke detector depicted in FIG. 2A, the latter is preferred due to its insensitivity to certain gaseous components which may be present. For example, the Taguchi gas sensor responds not only to smoke, but to ammonia and to other gases and may not be entirely suited for all applications.

Although the invention has been described with reference to a preferred embodiment, it should be understood that certain modifications and variations will readily occur to those with ordinary skill in the art. Numerous modifications in certain details of the electronic circuits are certainly possible. Accordingly, all such modifications and variations are intended to be included within the scope of the invention, except as limited by the express terms of the appended claims.

What we claim is:

1. An exit illuminating system for leading persons to an escape route under emergency conditions, comprising:

means for connecting the system to an alternating current power line;

a rectifier circuit for converting said alternating current power into direct current;

a battery;

means connecting said direct current from the rectifier circuit to the battery so as to provide a substantially continuously available charging current to said battery when alternating current is present on said power line, said means including a current control transistor in series between said converted direct current and said battery for controlling the charging current supplied to said battery, and a biasing circuit including said battery connected to said current control transistor in order to bias the degree of conduction thereof in accordance with the battery voltage;

a smoke sensor for developing an electrical activating signal when the surrounding atmosphere in an area to be protected contains a predetermined amount of smoke;

a high intensity light source coupled to said electrical current source and adapted for mounting adjacent an exit, said light source being responsive to the activating electrical signal by the smoke sensor for providing a high intensity illumination sufficiently visible through the smoke in such atmosphere so as to guide persons who may be trapped therein to an escape route via the exit; and means connecting said battery to said high intensity light source whereby direct current is made available to said light source during both the presence and failure of alternating current on the power line, thereby to render such system fail-safe in the event of power line failure.

2. The exit illuminating system of claim 1, wherein the biasing circuit for said current control transistor comprises in addition:

means excited by the converted alternating current power to provide a reference voltage; and temperature compensating means connected to said reference voltage for varying the bias signal applied to said current control transistor in accordance with the temperature of the atmosphere in the protected area.

3. The exit illuminating system of claim 1, wherein:

the bias circuit for said current control transistor is operative to render said transistor substantially nonconductive upon failure of the converted direct current, and thereby isolating the battery from said rectifier circuit in the event of line power failure.

4. The exit illuminating system of claim 1, further comprising:

means responsive to the battery charging current supplied through said current control transistor;

electronic switch means responsive to said current responsive means so as to close said switch when said charging current is less than a predetermined current value corresponding to a substantially full charge on said battery;

electrical indicating means; and means connecting said switch between the electrical current source means and the indicating means whereby said indicating means provides a visible indication of the state of charge of said battery.

* * * * *